US005303690A

United States Patent [19]

Ishii

[11] Patent Number: 5,303,690

[45] Date of Patent: Apr. 19, 1994

[54] TILE CUTTER

[75] Inventor: Akinori Ishii, Hyogo, Japan

[73] Assignee: Kabushiki Kaisha Ishii Choko Kogu Seisakusho, Hyogo, Japan

[21] Appl. No.: 903,892

[22] Filed: Jun. 25, 1992

[30] Foreign Application Priority Data

Jul. 2, 1991 [JP] Japan ..... 3-050841

[51] Int. Cl.[5] ..... B28D 1/24

[52] U.S. Cl. ..... 125/23.2; 125/23.01; 225/96.5

[58] Field of Search ..... 125/23.1, 23.2; 225/96, 225/96.5

[56] References Cited

U.S. PATENT DOCUMENTS 4,693,232 9/1987 Yasuga ..... 225/96.5
4,881,439 11/1989 Biedermann et al. ..... 225/96.5
5,040,521 8/1991 Pourtau et al. ..... 125/23.2

FOREIGN PATENT DOCUMENTS 1175303 3/1959 France ..... 125/23.2
932640 7/1963 United Kingdom ..... 125/23.2
1476286 6/1977 United Kingdom .

*Primary Examiner*—Hien H. Phan
*Attorney, Agent, or Firm*—Marshall, O'Toole, Gerstein, Murray & Borun

[57] ABSTRACT

This disclosure relates to a tile cutter including a generally horizontal base plate, a linear ridge fixed to the base plate, and at least one guide rail extending above and in parallel with the ridge. A slider is slidable on the rail. A manipulating lever including a main portion and an end portion is provided, the end portion having front and rear ends respectively away from and adjacent the main portion. The rear end is supported pivotably on the top of the slider on a first axis extending in parallel to the base plate and perpendicularly to the rail. A lower link is supported rotatably on the bottom of the slider on a second axis extending in parallel to the first axis. An intermediate link interconnects the front end of the lever end portion and one end of the lower link, the other end of which carries a cutting blade and press plates.

6 Claims, 4 Drawing Sheets

TILE CUTTER

FIELD AND BACKGROUND OF THE INVENTION

This invention relates to a cutter for pottery or ceramic tiles as architectural material.

FIG. 6 of the accompanying drawings shows a prior art tile cutter of this type, as also is shown in the Japanese utility model provisional publication S.56-156613. In FIG. 6, the cutter includes a horizontal base plate 1', a linear ridge 14' fixed to it, a pair of guide rails (only one shown) 3' extending above and in parallel with the ridge 14' between end supports 2', a slider 5' slidable on the rails 3', a pivotal block 4B' supported on the slider 5' by a horizontal hinge pin 5a', and a manipulating lever 4A' fixed to the block 4B'. The block 4B' carries a cutter blade 8' and a pair of press plates 9'. A tile 13A' can be cut by depressing the lever 4A' at the left end of tile 13A', pushing the lever 4A' to move the slider 5' until the blade 8' makes a straight cut or scratch in the tile surface and leaves the right end of the tile, and then further depressing the lever 4A' to force the press plates 9' against the tile on both sides of ridge 14', thereby breaking the tile along the cut.

As also shown in FIG. 5, the lever 4A, and block 4B' pivot around the single hinge pin 5a'. Because the length T1 of block 4B' is relatively large, the lever ratio T/T1 and force fl are small (f T = fl T1). Because the angle $\gamma$ between the block 4B' and tile is large, the value of cos $\gamma$ is small. Eventually, the vertical pressure p on the tile is small (p = f1 cos $\gamma$). Accordingly, it is necessary to apply a fairly large force f on the lever 4 to form a cut and to break a tile.

SUMMARY OF THE INVENTION

It is a general object of the invention to provide a tile cutter capable of breaking a tile, even if it is relatively thick, by applying a relatively small manipulating force.

A tile cutter according to the invention comprises a generally horizontal base plate, a linear ridge fixed to the base plate, at least one guide rail extending above and in parallel with the ridge, a slider slidable on the rail, a manipulating lever including a main portion and an end portion, which has front and rear ends respectively away from and adjacent the main portion, the rear end being supported pivotably on the top of the slider on a first axis extending in parallel to the base plate perpendicularly to the rail, a lower link supported rotatably on the bottom of the slider on a second axis extending in parallel to the first axis, and an intermediate link interconnecting the front end of the lever end portion and one end of the lower link, the other end of which carries a cutting blade and press plates.

BRIEF DESCRIPTION OF THE DRAWINGS

A preferred embodiment of the invention is shown in the accompanying drawings, wherein.

DETAILED DESCRIPTION OF THE INVENTION

Figure 1:
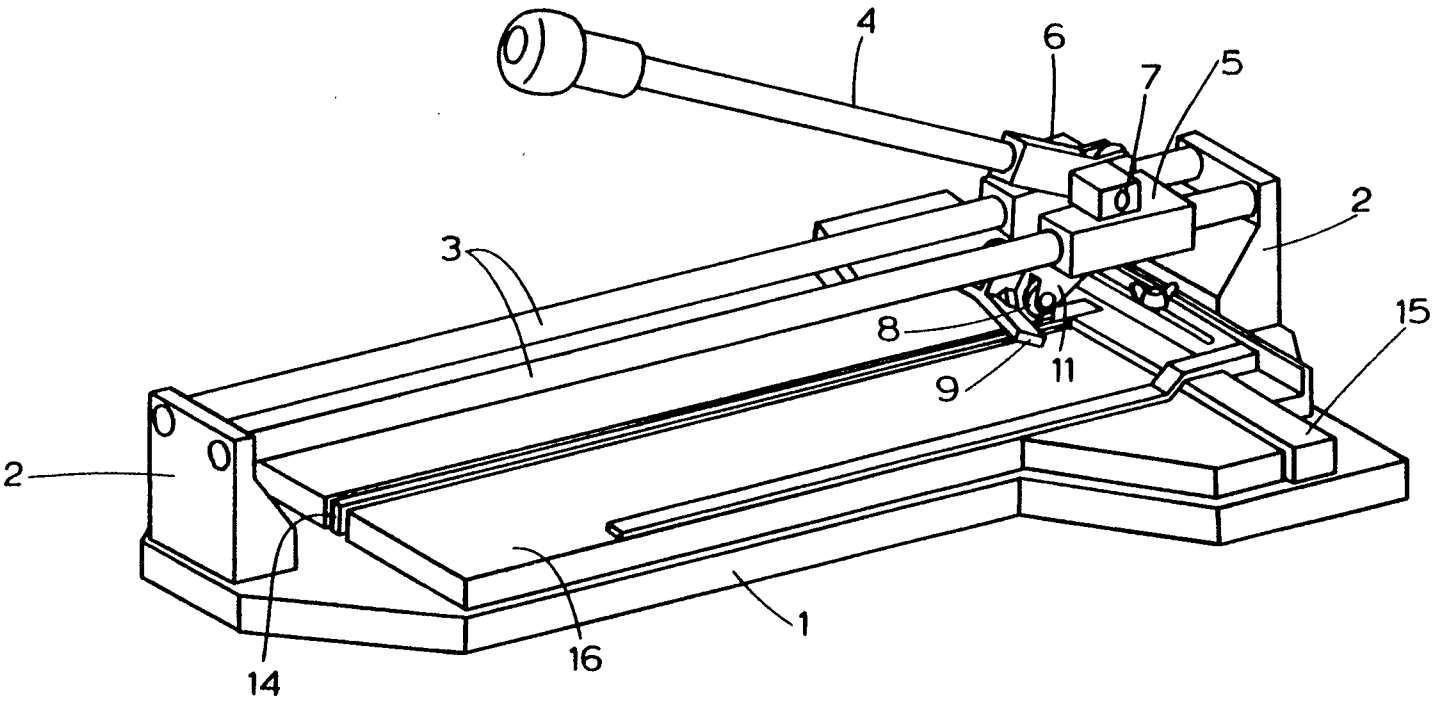
FIG. 1 is a perspective view of a tile cutter according to the invention.

With reference to FIG. 1, a horizontal base plate 1 has end supports 2 fixed to it. Adjacent the front support 2, a gauge bar 15 is fixed to the plate 1. Between this bar 15 and rear support 2, a straight ridge 14 is fixed to the plate 1 perpendicularly to the bar 15. On both sides of ridge 14, elastic sheets 16 are adhered to the plate 1.

A pair of guide rails 3 extend between the end supports 2 above and in parallel with the ridge 14, which is located midway between the rails 3. A slider 5 is mounted slidably on the rails 3 between the supports 2. A manipulating lever 4 is fixed to one end of a foot 6 which is supported on the top of slider 5 by a horizontal hinge pin 7 perpendicular to the rails 3.

Figure 2:
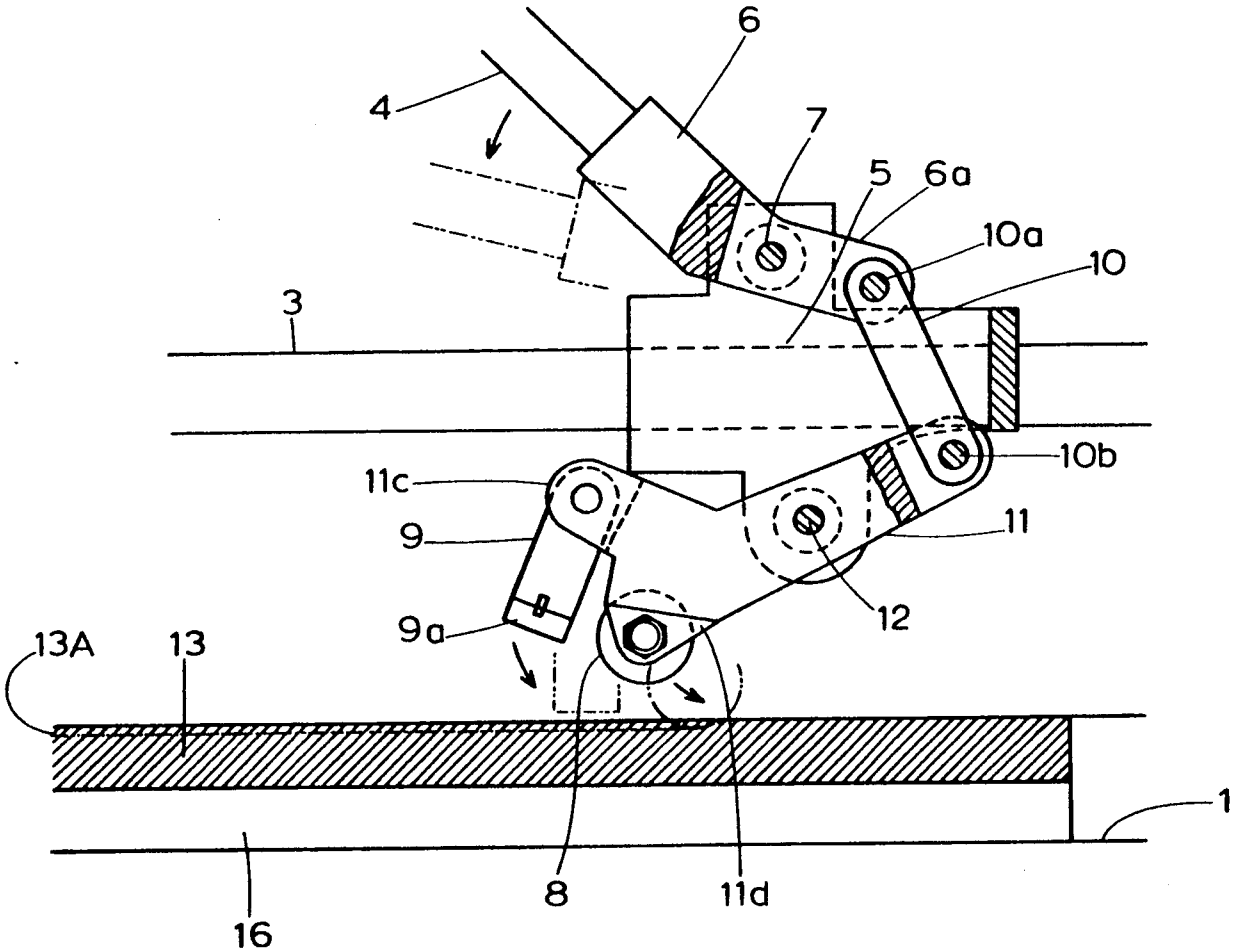
FIG. 2 is an enlarged fragmentary side view partially in cross section of the cutter of FIG. 1.

As shown in FIG. 2, the other end 6a of the foot 6 is connected pivotally by a pin 10a to one end of an intermediate link 10, the other end of which is connected pivotally by a pin 10b to one end of a lower link 11. The lower link 11 is supported rotatably on the bottom of the slider 5 by another hinge pin 12 which is parallel to the pin 7.

The other end of the lower link 11 is bifurcated with two pairs of spaced brackets 11c and 11d. The front or lower brackets 11d carry a cutting blade 8 rotatable on an axis parallel to the pins 7 and 12. The rear or upper brackets 11c carry a press member 9 pivotable on an axis parallel to the pins 7 and 12. The press member 9 has a pair of bottom wings or plates 9a.

Figure 3:
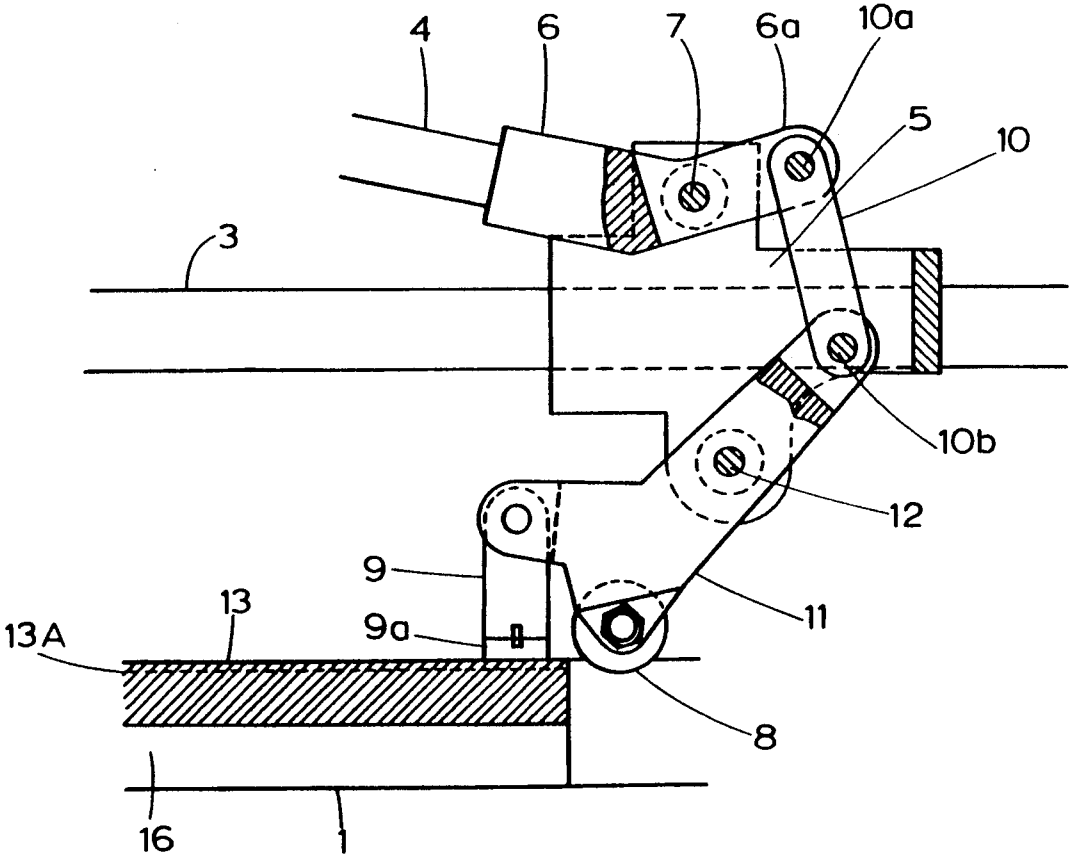
FIG. 3 is a view similar to FIG. 2, but showing the cutter in a different position.

As shown in FIG. 3, when the outer end of the lever 4 is lowered, the end 6a and the intermediate link 10 is lifted to rotate the lower link 11 counterclockwise around the pin 12, thereby lowering the blade 8 and the press member 9.

In operation, a tile 13 is placed on the elastic sheets 16 and over the ridge 14, with an intended cutting line of the tile aligned with the ridge 14. The lever 4 is lowered to first press the blade 8 against the rear end (the left end) of tile 13 and pushed forwardly (toward the right) to form a straight cut or groove 13A (FIG. 3) in the tile surface must above the ridge 14. When the blade 8 has just passed the tile 13 as shown in FIG. 3, the lever 4 is further depressed to press the feet 9a of the press member 9 against the tile 13 on opposite sides of the ridge 14, which will be broken into two pieces along the ridge 14.

Figure 4:
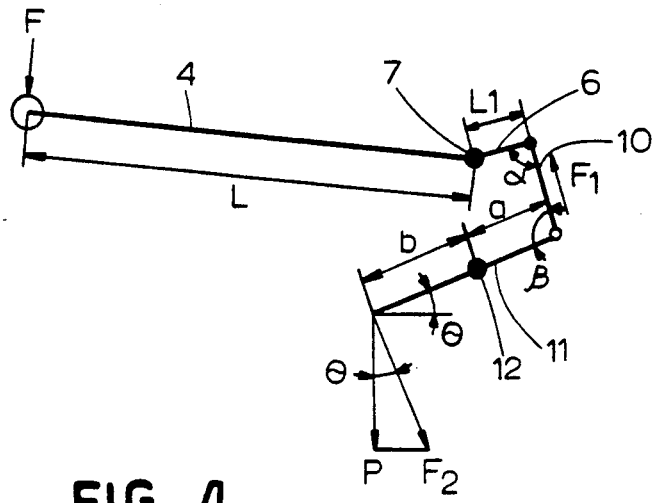
FIG. 4 is a schematic force diagram of a tile cutter according to this invention.
Figure 5:
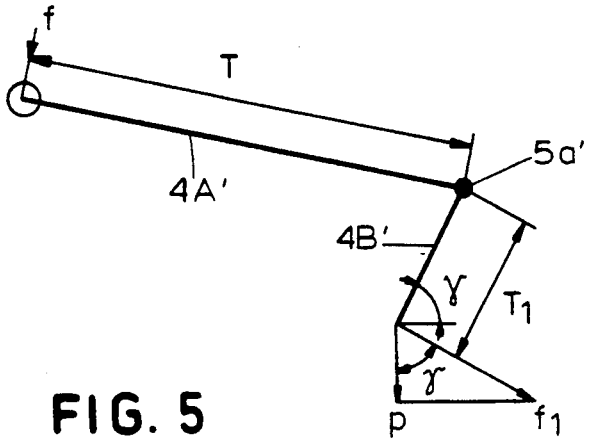
FIG. 5 PRIOR ART
FIG. 5 is a schematic force diagram of a prior art tile cutter shown in FIG. 6.
Figure 6:
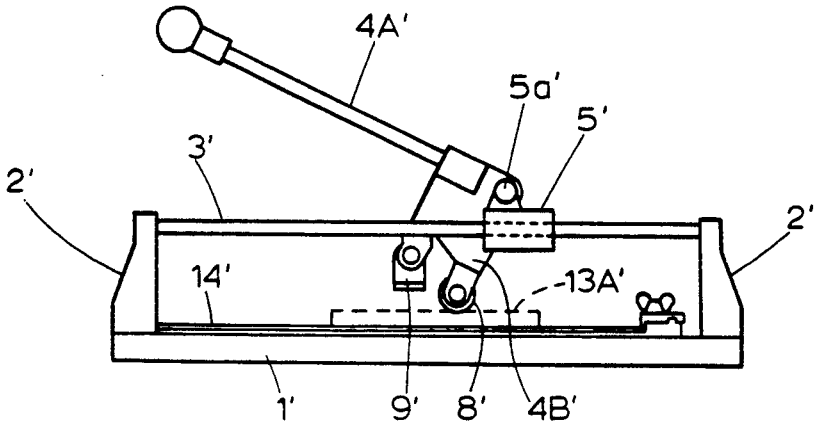
FIG. 6 PRIOR ART
FIG. 6 is a side view of a prior art tile cutter.

With reference to FIGS. 4 and 5, a comparison is made between the pressures P and p at the press plates 9 and 9', which are obtained from the manipulating forces F and f on the levers 4 and 4A', of the invention and the prior art, respectively.

In FIG. 4, if the angles $\alpha$, $\beta$ between the intermediate link 10 and the lever foot end 6a and lower link 11, respectively, are substantially right angles, and the lengths a and b of lower link 11 on both sides of pin 12 are substantially the same, the forces F1 and F2 at both ends of lower link 11 are substantially the same. The angle $\theta$ between the lower link 11 and horizontal plane (tile surface) can be small. The pressure P at the press plates is substantially proportional to the lever ratio L/L1 of lever 4 and foot 6 and to cos $\theta$, i.e. $P \propto (L/L1) \times \cos\theta$. Consequently, by making the lever ratio L/L1 large and the angles $\alpha$, $\beta$ substantially right angles, and arranging the lower link 11 to be as horizontal as possible, it is possible to further increase the pressure P.

Likewise in the prior art, as shown in FIG. 5, the pressure p is proportional to the lever ratio T/T1 and cos $\gamma$, i.e. $p \propto (T/T1) \times \cos\gamma$.

Consequently, in FIGS. 4 and 5, if the manipulating forces F and f and the lever lengths L and T are the same (F = f, L = T), the pressure ratio $P/p \propto (T1/L1) \times (\cos\theta/\cos\gamma)$. If $T1/L1 \approx 5$ to 10 and $\cos\theta/\cos\gamma \approx 2$, the pressure P in the invention is about 10 to 20 times as large as the pressure p in the prior art.

What is claimed is:

1. A tile cutter comprising a generally horizontal base plate, a linear ridge fixed to the base plate, at least one guide rail mounted on said base plate and extending above and in parallel to said ridge, said base plate having a forward side and a rearward side and said linear ridge and said guide rail extending from said forward side to said rearward side a slider slidable on said rail, a manipulating lever including a main portion and an end portion, means for pivotably supporting said end portion on said slider on a first axis extending in parallel to the base plate and perpendicularly to said guide rail, said end portion extending toward said forward side from said first axis and said main portion extending toward said rearward side from said end portion and from said first axis, a lower link supported rotatably on said slider on a second axis which extends in parallel with said first axis and is between said first axis and said base plate, and an intermediate link interconnecting said end portion and said lower link, said intermediate link, having first and second pivotable connections with said end portion and one end of said lower link, respectively, said first and second pivotable connections being forwardly of said first and said second axes, and a cutting blade and press plates being attached to the other end said lower link.

2. A tile cutter as set forth in claim 1, said end portion and said lower link having longitudinal axes, and wherein, at a point in the pivoting movements of said lever, said intermediate link and said lower link, said longitudinal axes extend toward said forward side and are generally parallel, and said intermediate link makes substantially right angles with said longitudinal axes.

3. A tile cutter as set forth in claim 2, wherein said lower link extends substantially equal distances on opposite sides of said second axis.

4. A tile cutter as set forth in claim 3, wherein said longitudinal axis of said lower link is at an acute angle relative to said base plate.

5. A tile cutter comprising a generally horizontal base plate having a forward side and a rearward side, a linear ridge fixed to the base plate, at least one guide rail mounted on said base plate and extending above and in parallel to said ridge between said forward and rearward sides, a slider slidable on said rail, a manipulating lever including a main portion and an end portion, means for pivotably supporting said end portion on said slider on a first axis extending in parallel to the base plate and perpendicularly to said guide rail, a lower link supported rotatably on said slider on a second axis which extends in parallel with said first axis and is between said first axis and said base plate, and an intermediate link interconnecting said end portion and one end of said lower link, a cutting blade and press plates attached to the other end said lower link, said intermediate link, said end portion and said lower link having longitudinal axes, wherein, at a point in the pivoting movements of said lever, said intermediate link and said lower link, said longitudinal axis of said intermediate link makes substantially right angles with said longitudinal axis of said end portion and said lower link, said lower link extending substantially equal distances on opposite sides of said second axis.

6. A tile cutter as set forth in claim 5, wherein said longitudinal axis of said lower link is at an acute angle relative to said base plate.

* * * * *